US007828586B2

(12) United States Patent
Gorczyca et al.

(10) Patent No.: US 7,828,586 B2
(45) Date of Patent: Nov. 9, 2010

(54) HIGH VOLTAGE POWER SUPPLY CONNECTOR SYSTEM

(75) Inventors: John A. Gorczyca, Lansdale, PA (US); Richard D. Rodrigo, Chalfont, PA (US)

(73) Assignee: Illinois Tool Works Inc., Glenview, IL (US)

( * ) Notice: Subject to any disclaimer, the term of this patent is extended or adjusted under 35 U.S.C. 154(b) by 480 days.

(21) Appl. No.: 11/763,270

(22) Filed: Jun. 14, 2007

(65) Prior Publication Data

US 2008/0309310 A1 Dec. 18, 2008

(51) Int. Cl.
*H01R 29/00* (2006.01)

(52) U.S. Cl. ..... 439/489; 439/955

(58) Field of Classification Search ..... 439/489, 439/955; 361/212, 213, 235; 363/146
See application file for complete search history.

(56) References Cited

U.S. PATENT DOCUMENTS

| | | | | |
|---|---|---|---|---|
| 3,258,713 | A * | 6/1966 | George | 331/3 |
| 4,397,513 | A * | 8/1983 | Clark et al. | 439/357 |
| 4,876,712 | A * | 10/1989 | Brint et al. | 379/387.01 |
| 4,915,639 | A * | 4/1990 | Cohn et al. | 439/188 |
| 4,919,508 | A * | 4/1990 | Grace et al. | 385/56 |
| 5,057,966 | A | 10/1991 | Sakata et al. | |
| 5,169,328 | A * | 12/1992 | Johnson | 439/188 |
| 5,297,015 | A * | 3/1994 | Miyazaki et al. | 363/146 |
| 5,341,254 | A * | 8/1994 | Ueno | 360/62 |
| 5,357,076 | A * | 10/1994 | Blankenship | 219/121.54 |
| 5,660,567 | A * | 8/1997 | Nierlich et al. | 439/620.21 |
| 6,049,143 | A * | 4/2000 | Simpson et al. | 307/126 |
| 6,061,261 | A | 5/2000 | Chen et al. | |
| 6,118,645 | A * | 9/2000 | Partridge | 361/231 |
| 6,330,146 | B1 | 12/2001 | Blitshteyn et al. | |
| 6,685,701 | B2 * | 2/2004 | Orszulak et al. | 606/34 |
| 6,913,477 | B2 * | 7/2005 | Dayan et al. | 439/188 |
| 7,028,202 | B2 * | 4/2006 | Long et al. | 713/340 |
| 7,167,078 | B2 * | 1/2007 | Pourchot | 340/5.61 |
| 7,177,168 | B2 * | 2/2007 | Toyomura et al. | 363/131 |
| 7,204,825 | B2 * | 4/2007 | Cimino et al. | 604/113 |
| 7,526,582 | B2 * | 4/2009 | Best et al. | 710/15 |
| 2002/0044473 | A1 | 4/2002 | Toyomura et al. | |
| 2010/0067197 | A1 * | 3/2010 | Guccione et al. | 361/728 |

FOREIGN PATENT DOCUMENTS

WO 02089036 11/2002

OTHER PUBLICATIONS

"International Search Report and the Written Opinion of the International Searching Authority," for PCT/US2008/063680, Date of mailing: Oct. 22, 2008, 19 pages.

* cited by examiner

*Primary Examiner*—Neil Abrams
(74) *Attorney, Agent, or Firm*—Panitch Schwarze Belisario & Nadel LLP

(57) ABSTRACT

A connector system is provided for coupling an ionization emitter to an high voltage (HV) supply. The connector system includes one or more contacts for distributing voltage from the HV supply to the emitter. The connector system further includes a detection device that detects an element of an emitter that provides one or more properties of the emitter. The connector system further includes a detection logic device that sets one or more operating parameters of the HV supply according the one or more properties provided by the element of the emitter.

10 Claims, 3 Drawing Sheets

HIGH VOLTAGE POWER SUPPLY CONNECTOR SYSTEM

BACKGROUND OF THE INVENTION

Air ionization is an effective method of creating or eliminating static charges on non-conductive materials and isolated conductors. Air ionizers generate large quantities of positive and/or negative ions in the surrounding atmosphere which serve as mobile carriers of charge in the air. As ions flow through the air, they are attracted to oppositely charged particles and surfaces. Creation or neutralization of electrostatically charged surfaces can be rapidly achieved through this process.

Air ionization may be performed using electrical ionizers which generate ions in a process known as corona discharge. Electrical ionizers generate air ions through this process by intensifying an electric field around a sharp point until it overcomes the dielectric strength of the surrounding air. Negative corona occurs when electrons are flowing from the electrode into the surrounding air. Positive corona occurs as a result of the flow of electrons from the air molecules into the electrode.

Ionizer devices, such as an electrostatic charging system, an ionization system, or an alternating current (AC) or direct current (DC) charge neutralizing system, take many forms such as ionizing bars, air ionization blowers, air ionization nozzles, and the like, and are utilized to create or neutralize static electrical charge by emitting positive and negative ions into the workspace or onto the surface of an area. Ionizing bars are typically used in continuous web operations such as paper printing, polymeric sheet material, or plastic bag fabrication. Air ionization blower and nozzles are typically used in workspaces for assembling electronics equipment such as hard disk drives, integrated circuits, and the like, that are sensitive to electrostatic discharge (ESD). Electrostatic charging systems are typically used for pinning together paper products such as magazines or loose leaf paper.

Ionizers typically include at least one ionization emitter that is powered by a high voltage supply. The configuration of an ionization emitter can vary, depending on the application for which the ionizer is being used. Conventionally, a user must pre-program, configure or otherwise set up operating parameters of the power supply to work with a particular configuration of an ionization emitter. If a power supply is not set up correctly to work with a particular configuration, the power supply can apply an excessive voltage to the ionizer or can generate high voltage when no ionizer is present. The incorrect ionizer configurations can result in undesired results in the application and potential damage to the ionizer and/or power supply.

Thus, there is an unmet need for a connector system that allows a power supply to sense the presence and configuration of the ionization bar and automatically apply the correct voltages and output frequencies.

SUMMARY OF THE INVENTION

A connector system is provided for coupling an ionization emitter to an high voltage (HV) supply. The connector system includes one or more contacts for distributing voltage from the HV supply to the emitter. The connector system further includes a detection device that detects an element of an emitter that provides one or more properties of the emitter. The connector system further includes a detection logic device that sets one or more operating parameters of the HV supply according the one or more properties provided by the element of the emitter.

BRIEF DESCRIPTION OF THE DRAWINGS

The following drawings provide examples of the invention. However, the invention is not limited to the precise arrangements, instrumentalities, scales, and dimensions shown in these examples, which are provided mainly for illustration purposes only. In the drawings.

DETAILED DESCRIPTION OF THE INVENTION

Figure 1:
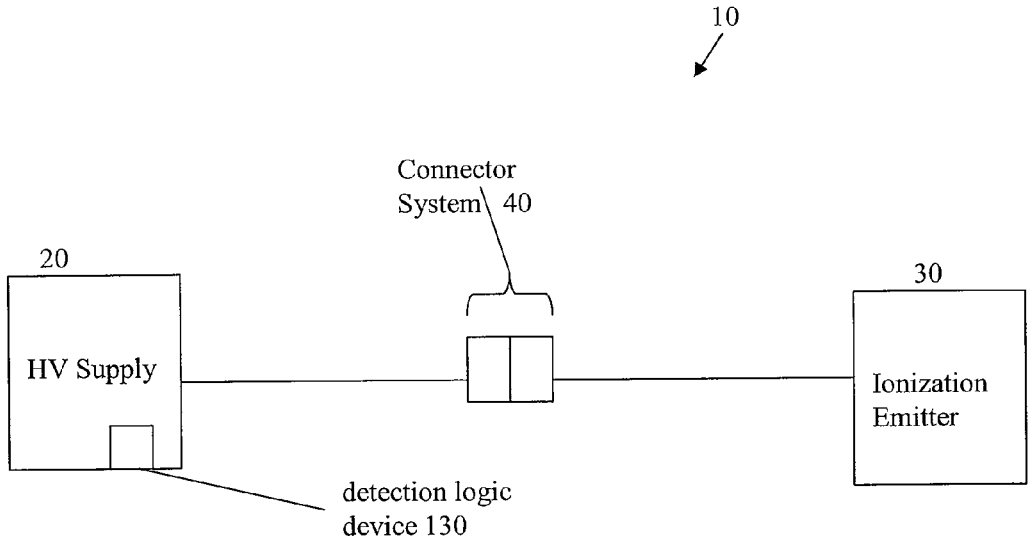
FIG. 1 is a schematic block diagram of an ionization device in accordance with a preferred embodiment of the present invention.

FIG. 1 shows an ionization device 10 according to one embodiment of the present invention. Examples of ionization devices 10 include an electrostatic charging system, an ionization system, and an alternating current (AC) or direct current (DC) charge neutralizing system. The ionization device 10 includes at least one high voltage (HV) supply 20. The HV supply 20 may supply an AC or a DC voltage of about 3 kV to about 60 kV. The HV supply 20 further includes a detection logic device 130. In one preferred embodiment, the detection logic device 130 is an embedded processor. In another preferred embodiment, the detection logic device is sensing circuitry. The ionization device 10 further includes at least one ionization emitter (emitter) 30. The emitter 30 is connected to the HV supply 20 by a connector system 40. The HV supply 20 supplies an input voltage to power the emitter 30. The input voltage that the emitter 30 is designed to receive from the HV supply 20 is described by operating parameters which may include voltage level, current level, frequency, maximum voltage, minimum voltage, maximum current, minimum current, pulse time, etc. The connector system 40 provides one or more properties of the emitter 30 to the detection logic device 130 in the HV supply 20. The detection logic device 130 has detection logic that controls one or more operating parameters of the high voltage power supply 20 to adjust to the correct settings for the connected emitter 30. In an alternative embodiment, the detection logic could be included the connector system 40 so that the connector system 40 could directly modify analog control voltages in the high voltage power supply 20 based on the properties provided in the connector system 40. If no emitter 30 is detected, the high voltage power supply 20 can automatically shutdown the output voltage.

Figure 2:
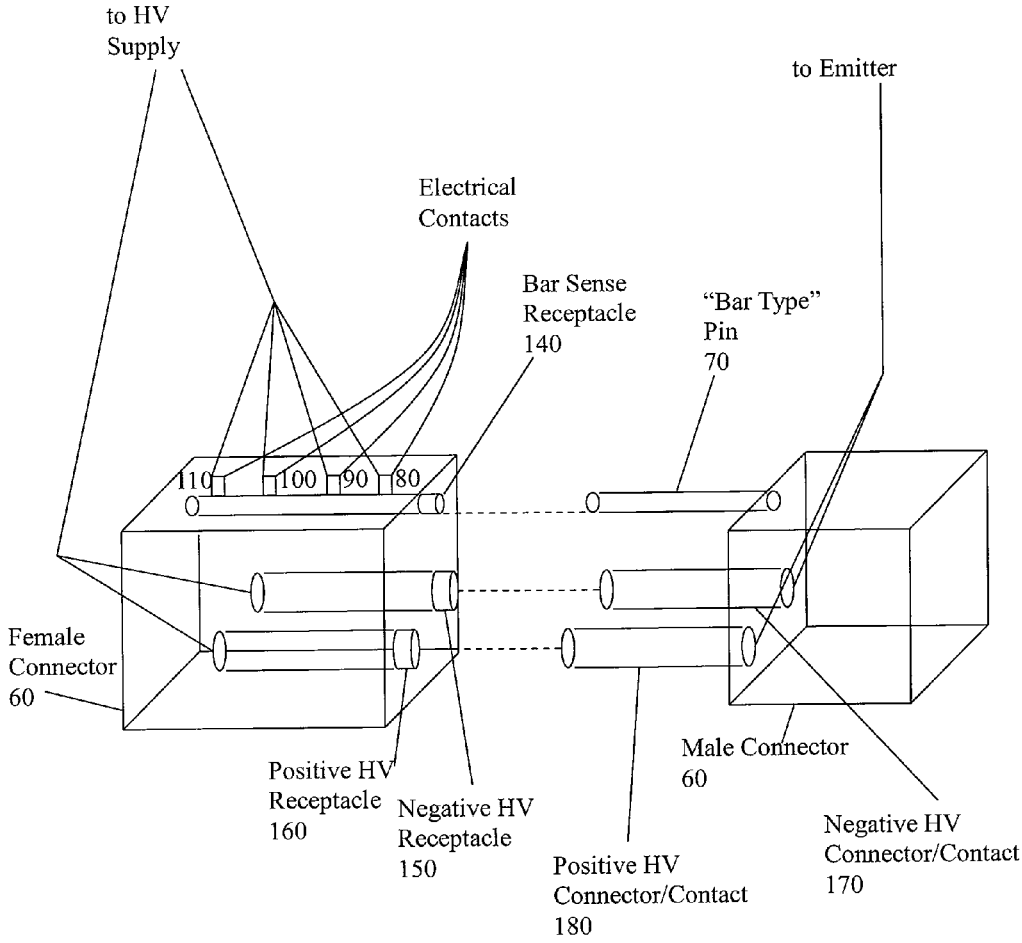
FIG. 2 is an exploded view of a schematic diagram of one detailed implementation of a connector system in accordance with a preferred embodiment of the present invention.

FIG. 2 shows a connector system 40 according to one embodiment of the present invention. The connector system 40 has a male connector 50 (male end) and a female connector 60. Typically, the male end 50 is integral with an emitter 30 (see FIG. 1) such as an ionizer bar. The female connector 60 is chassis mounted in the HV power supply 20 (see FIG. 1). The male connector 50 has an element, such as a 'bar type' pin 70 (the pin), that has one or more properties that can be detected. In one preferred embodiment, the property of the 'bar type' pin 70 (the pin) is a predetermined length where the length of the pin 70 of the male connector 50 is varied and is used to indicate the configuration of the emitter 30. The male connector 50 also has a positive HV connector/contact 180 and a negative HV connector/contact 170 for distributing voltage from the HV supply 20 to the emitter 30. The female connector 60 has three receptacles 140, 150, 160. A negative HV receptacle 150 receives the negative HV connector 170 of the male connector 50. A positive HV receptacle 160 receives the positive HV connector 180 of the male connector 50. A bar sense receptacle 140 is a detection device that detects the properties of the emitter 30 that are provided by the pin 70.

In one preferred embodiment, the bar sense receptacle 140 receives the pin 70 of the male connector 50 and detects the length of the pin 70. The bar sense receptacle 140 of the female connector 60 incorporates sensing contacts 80, 90, 100, 110. The first contact 80 is a ground. When the pin 70 is inserted into the female connector 60, the pin 70 is connected to ground by the first contact 80. Subsequent contacts 90, 100, 110 are held to a logical high level when they are not in contact with the pin 70. When the pin 70 is in contact with the ground 80 and a subsequent contact 90, 100, 110, the subsequent contact 90, 100, 110 will be connected to the ground 80 through the pin 70. As the subsequent contacts 90, 100, 110 become grounded, they are used to sense the length of the pin 70.

The female connector 60 is connected to the HV supply 20 (see FIG. 1). The length of the pin 70 is interpreted by the detection logic device 130 (see FIG. 1) in the HV supply 20 (see FIG. 1). The detection logic device 130 (see FIG. 1) then controls the HV supply 20 (see FIG. 1) to adjust to the correct operating parameters for the connected emitter 30 (see FIG. 1). The operating parameters which may be adjusted include the voltage, current or frequency of the power supplied by the HV supply as well as output limitations for the HV supply such as maximum current, minimum current, maximum voltage, minimum voltage or pulse time.

In other embodiments of the connector system 40 of the present invention, physical characteristics such as width, circumference, shape, curvature, color, optical pattern or optical properties of the pin 70 of the male connector 50 are varied in order to indicate the configuration of the emitter 30. Further embodiments could incorporate wireless sensing methods such as radio-frequency identification (RFID), with the pin 70 replaced by an RFID type tag in the connector system 40.

Figure 3:
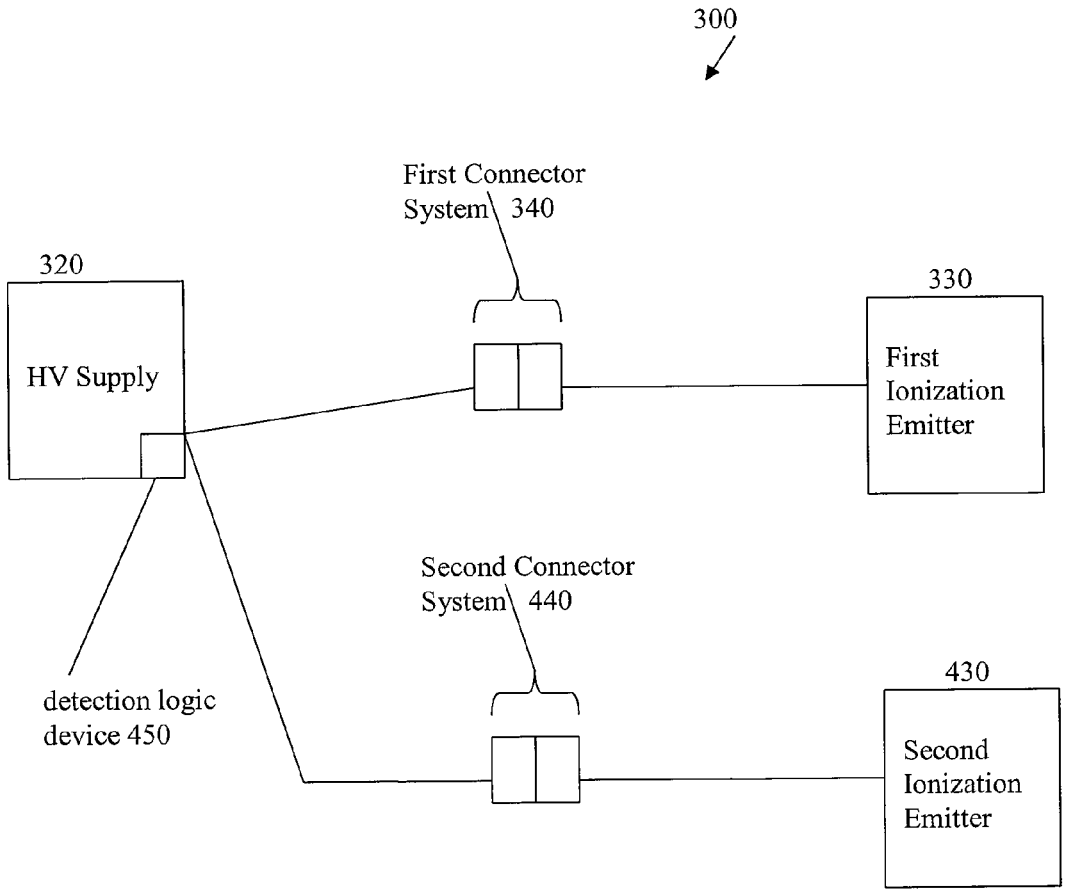
FIG. 3 is a schematic block diagram of an ionization device in accordance with another preferred embodiment of the present invention.

FIG. 3 shows an ionization device 300 according to another embodiment of the present invention. The ionization device 300 may be an electrostatic charging system, an ionization system, or an alternating current (AC), direct current (DC) or pulse DC charge neutralizing system. The ionization device 10 includes a high voltage (HV) supply 320. The HV supply 320 may supply an AC or a DC voltage of about 3 kV to about 60 kV. The HV supply 320 further includes a detection logic device 450, which may also be either an embedded processor or sensing circuitry. The ionization device 300 further includes at least a first ionization emitter (first emitter) 330 and a second ionization emitter (second emitter) 430. The first emitter 330 is connected to the HV supply 320 by a first connector system 340 that provides one or more properties of the first emitter 330 which are used to set one or more operating parameters of the HV supply 320. The second emitter 430 is connected to the HV supply 320, in parallel to the first emitter 330, by a second connector system 440 that provides one or more properties of the second emitter 430 which are used to set one or more operating parameters of the HV supply 320. The emitters 330, 430 can be sensed independently by the connection systems 340, 440, respectively. In one preferred embodiment, the power supply 320 configures itself for the emitter 330, 430 having the safest operating voltage or current, which generally would be the lower power of the two emitters 330, 440, thus ensuring safe operation of all connected emitters 330, 430. For example, if the first emitter 330 is intended to have 7 kilovolts (kV) supplied to it and the second emitter 430 is intended to have 12 kV, the HV supply 20 would be set to provide the lower of the two voltages (7 kV). In an alternative embodiment, the two connector systems 340, 440 are independent of one another and the HV supply 320 can configure a different input voltage to be supplied to each of the two emitters 330, 430 based on the detected properties of each of the emitters 330, 430.

It will be appreciated by those skilled in the art that changes could be made to the embodiments described above without departing from the broad inventive concept thereof. It is understood, therefore, that this invention is not limited to the particular examples disclosed, but it is intended to cover modifications within the spirit and scope of the present invention as defined by the appended claims.

What is claimed is:

1. A connector system for coupling an ionization emitter to a high voltage (HV) supply, the connector system comprising:

(a) one or more contacts for distributing voltage from the HV supply to the emitter;

(b) a detection device that detects a pin of the emitter that provides one or more properties of the emitter, the pin being physically and electrically separate from the one or more contacts, the detection device including a ground contact and a plurality of sensing contacts configured for contact with the pin, each of the plurality of sensing contacts being held to a logical high level when not in contact with the pin, and each respective sensing contact being grounded when connected to the ground contact through the pin; and (c) a detection logic device that sets one or more operating parameters of the HV supply according the one or more properties of the emitter.

2. The connector system of claim 1 wherein the detection device is a receptacle for receiving the pin.

3. The connector of claim 2 wherein the one or more properties of the emitter are defined by the length of the pin, and the detection device detects the length of the pin.

4. The connector system of claim 2, wherein the ground contact and the plurality of sensing contacts are disposed in the receptacle.

5. The connector of claim 1 wherein the emitter is an ionizing bar, and the detection device is a receptacle for receiving the pin.

6. The connector system of claim 1, wherein the HV is configured to shut down automatically when the pin is not detected by the detection device.

7. An ionizer device comprising:

(a) a high voltage (HV) supply;

(b) at least two ionization emitters connected in parallel to the HV supply, each connected to the HV supply by a connector system, each connector system including:

(i) one or more contacts for distributing voltage from the HV supply to the emitter, and (ii) a detection device that detects an element of the emitter that provides one or more properties of the emitter, the element of the emitter being physically and electrically separate from the one or more contacts, and (c) a detection logic device that sets one or more operating parameters of the HV supply according the one or more properties of the emitters, wherein one of the properties of each of the emitters is an operating voltage, and wherein the detection logic device is configured to supply the at least two ionization emitters with a lowest of the operating voltages of the respective emitters.

8. An ionization emitter comprising a pin that provides one or more properties of the emitter that are used to set one or more operating parameters of a high voltage supply that provides power to the emitter, the pin being physically and electrically separate from one or more contacts of the emitter that distribute voltage from the high voltage supply to the emitter, the pin being configured to connect a ground contact of a detection device with at least one of a plurality of sensing contacts of the detection device, each of the plurality of sensing contacts being held to a logical high level when not in contact with the pin.

9. The ionization emitter of claim 8 wherein the one or more properties of the emitter are defined by the length of the pin.

10. The ionization emitter of claim 8 wherein the emitter is an ionizing bar.

* * * * *